US006601936B2

(12) United States Patent
McDonald

(10) Patent No.: US 6,601,936 B2
(45) Date of Patent: Aug. 5, 2003

(54) REAL TIME ADAPTIVE INKJET TEMPERATURE REGULATION CONTROLLER

(75) Inventor: Calvin K. McDonald, Boise, ID (US)

(73) Assignee: Cypress Semiconductor Corp., San Jose, CA (US)

( * ) Notice: Subject to any disclaimer, the term of this patent is extended or adjusted under 35 U.S.C. 154(b) by 0 days.

(21) Appl. No.: 09/919,673

(22) Filed: Jul. 31, 2001

(65) Prior Publication Data

US 2002/0057306 A1 May 16, 2002

Related U.S. Application Data

(60) Provisional application No. 60/248,946, filed on Nov. 14, 2000.

(51) Int. Cl.[7] ..... B41J 29/38

(52) U.S. Cl. ..... 347/14; 347/17; 347/60; 347/185

(58) Field of Search ..... 347/14, 16, 60, 347/17, 185, 194, 186, 19, 11

(56) References Cited

U.S. PATENT DOCUMENTS 5,172,134 A * 12/1992 Kishida et al. ..... 346/1.1
5,745,130 A * 4/1998 Becerra et al. ..... 347/14
5,880,751 A * 3/1999 Nishikori et al. ..... 347/14

* cited by examiner

*Primary Examiner*—John Barlow
*Assistant Examiner*—Lam S Nguyen
(74) *Attorney, Agent, or Firm*—Marger Johnson & McCollom

(57) ABSTRACT

The invention relates to an inkjet temperature regulation controller that includes a time base circuit adapted to generate a clock signal and a head temperature sampler adapted to generate head temperature data by sensing print head temperature responsive to the clock signal. A preheat data generating circuit is adapted to translate the head temperature data into head preheat temperature data. A preheat data delivering circuit is adapted to provide the preheat temperature data to at least one preheating element. A monitor circuit is adapted to generate statistical data according to the head temperature data. The preheat data generating circuit receives updated head preheat temperature data responsive to the statistical data.

25 Claims, 4 Drawing Sheets

REAL TIME ADAPTIVE INKJET TEMPERATURE REGULATION CONTROLLER

This application claim benefit of No. 60/248,946 filed Nov. 14, 2000.

BACKGROUND OF THE INVENTION

1. Field of the Invention

This invention relates to inkjet printing systems and, more particularly, to a real time adaptive inkjet temperature regulation controller adapted to accurately control the temperature on an inkjet print head.

2. Description of the Related Art

Impact printing systems rely on permanently shaped character elements physically contacting a recording medium. An example of an impact printing system is a typewriter where the character elements are permanently shaped as individual letters of the alphabet. The individual character elements contact the paper through a print ribbon when actuated by a user. Impact printing systems are generally considered slow, bulky, and noisy. Impact printing systems are, therefore, not recommended for high speed printing applications.

Non-impact printing systems use a variety of techniques to cause a desired image to be formed on the recording medium without necessitating contact between an image element and the recording medium. Examples of non-impact printing systems include thermal and non-thermal inkjet printing systems. Thermal inkjet printing systems thermally stimulate tiny droplets of ink in a chamber causing the droplets to eject from each of a plurality of print head nozzles. The ejected drops of ink impinge on the recording medium at high speeds. The ejected drops of ink form selected images on selected locations of the recording medium.

A heating element is associated with each nozzle on the print head. The heating element might for example be a resistor located closely to the nozzle. The heating element is preheated with preheat data such that the ink in the chamber is maintained at a predetermined preheat temperature. When print data arrives, the heating element rapidly heats up from the predetermined preheat temperature to a firing temperature when a suitable current is applied to the heating element. A significant amount of thermal energy is transferred to the ink from the heating element resulting in vaporization of a small portion of the ink adjacent to the nozzle and producing a bubble in the chamber. The formation of this bubble, in turn, creates a pressure wave that propels a single ink droplet from the nozzle onto a nearby recording medium. By properly selecting the location of the ink heating mechanism with respect to the nozzle and with careful control of the energy transfer from the heating mechanism to the ink, the ink bubble will quickly collapse on or near the ink heating mechanism before any vapor escapes through the nozzle. If the preheat temperature is too high, the bubble vaporizes. If the preheat temperature is too low, the drop does not fire responsive to the print data.

Each image printed on the recording medium is made up of a plurality of ejected inkjet drops. The quality of the printed image depends on the size, placement, and timing of each inkjet drop. The size, placement, and timing of each inkjet drop, in turn, depend upon accurate temperature control of the corresponding ink chamber and heating element on the inkjet print head. Because the frequency of the nozzle firings is image dependent, it is difficult to predict the inkjet head temperature or to identify which portions of the inkjet head are at higher temperatures. Although slowing the head firing frequency lowers the inkjet head temperature, this is disadvantageous because it slows page throughput. It is therefore advantageous to control the temperature of the inkjet head in real time without necessarily slowing the head firing frequency. That is, it is advantageous to control the inkjet head temperature with as little delay as possible.

Additionally, market forces pressure manufacturers of inkjet printing systems to continuously improve image quality while reducing the cost of the overall printing system and improving printing speed. Thus, it is advantageous to accurately control the temperature of the inkjet head without incurring a cost burden to the product and consuming system performance.

BRIEF DESCRIPTION OF THE DRAWINGS

The foregoing and other objects, features, and advantages of the invention will become more readily apparent from the following detailed description of a preferred embodiment that proceeds with reference to the following drawings.

DETAILED DESCRIPTION OF THE PREFERRED EMBODIMENT

Figure 1:
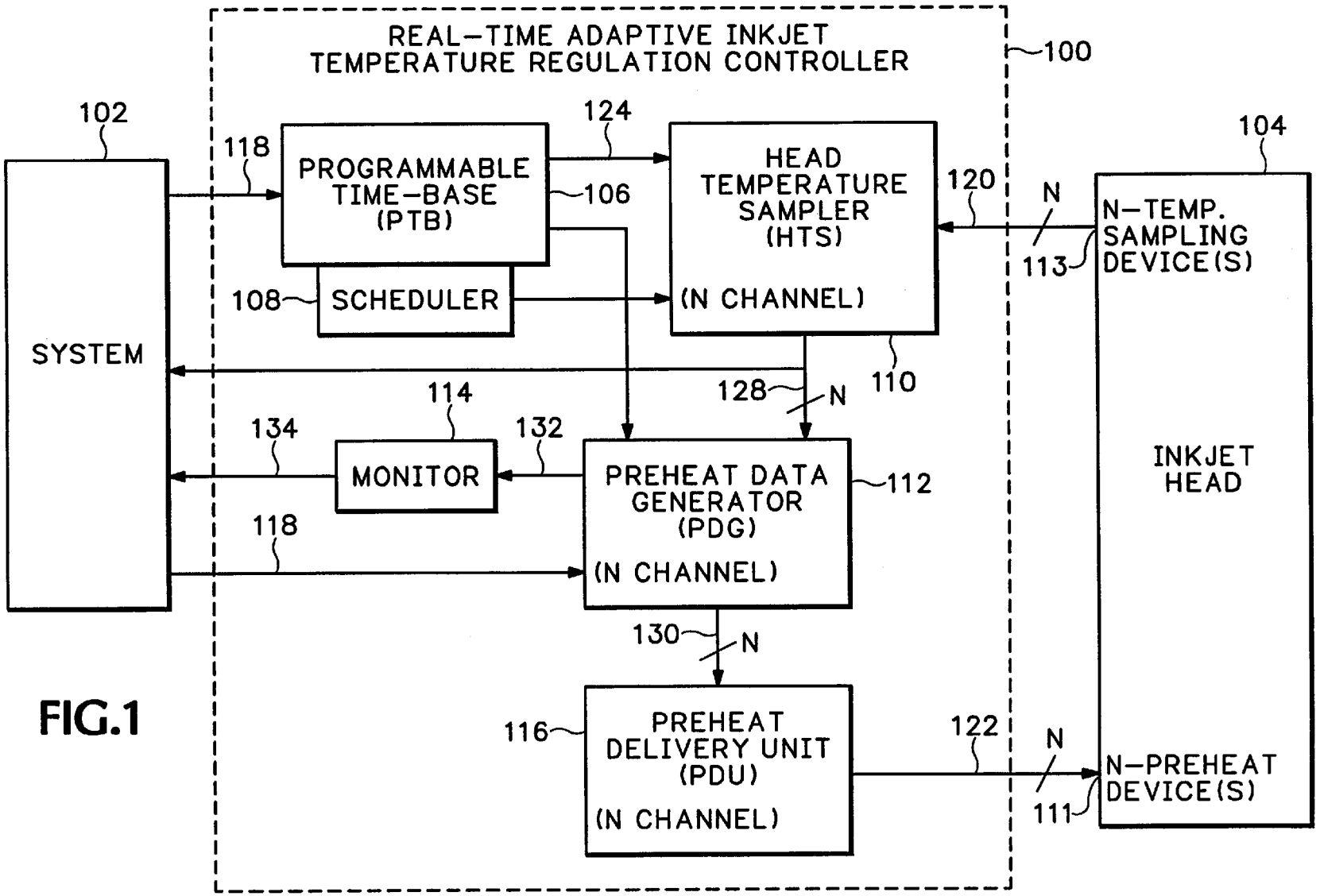
FIG. 1 is a block diagram of the real time adaptive inkjet temperature regulation controller system of the present invention.

Referring to FIG. 1, a real time adaptive inkjet temperature regulation controller 100 is adapted to regulate the temperature of the inkjet head 104 responsive to control signals 118 received from system 102. The system 102 might comprise software, hardware, or a combination of both software and hardware.

The print head 104 shown in FIG. 1 includes a plurality of preheating devices 111 adapted to preheat the print head 104. The preheating devices 111 preheat the print head 104 to a temperature indicated by the corresponding plurality of preheat data signals 122. The plurality of temperature sampling devices 113 determines the temperature of the print head 104 by sampling or reading the corresponding plurality of preheat devices 111. The temperature regulation controller 100, in turn, analyzes the temperature sampling signals 120 responsive to the control signals 118.

A person skilled in the art should recognize that the print head 104 might include single preheat and temperature sampling devices or combinations of a single preheat device with a plurality of sampling devices or vice versa instead of the plurality of preheat and temperature sampling devices 111 and 113, respectively, shown in FIG. 1. It is typical, however, for the number of preheating devices 111 to match the number of sampling devices 113.

A person skilled in the art should also recognize that several ways exist to preheat the head 104 depending on the design of the inkjet print head. For example, a series of digital pulses could be used to modulate a heating element or the head 104 could receive an encoded byte of data or an analog signal and translate these signals into preheating instructions to the heating element. Other such methods are considered to come within the scope of the present invention.

A head temperature sampler (HTS) circuit 110 senses a print head temperature through channels, each channel being represented by one of the plurality of temperature sampling signals 120. Where the print head 104 includes a single temperature sampling device, the HTS circuit 110 samples a single channel generating a single temperature sampling signal 120.

One embodiment of a temperature sampling device 113 includes an apparatus (not shown) capable of generating an analog voltage correlative to a print head temperature. Another embodiment of a temperature sampling device 113 is a temperature controlled oscillator (TCO) (not shown) that generates an oscillating signal whose frequency is proportional to the print head temperature. For example, the TCO might generate a 50% duty cycle digital square wave whose frequency might be correlated to an absolute print head temperature. The temperature regulation controller 100 might sample the frequency of the signal provided by the TCO to determine the temperature of the print head 104. Both of the above-described embodiments for the temperature sampling device 113 are well known to those in the art and will not be described in further detail. A person skilled in the art should recognize that the temperature sampling devices 113 might be implemented using a variety of different and well-known apparatus and methods including those described above.

Figure 2:
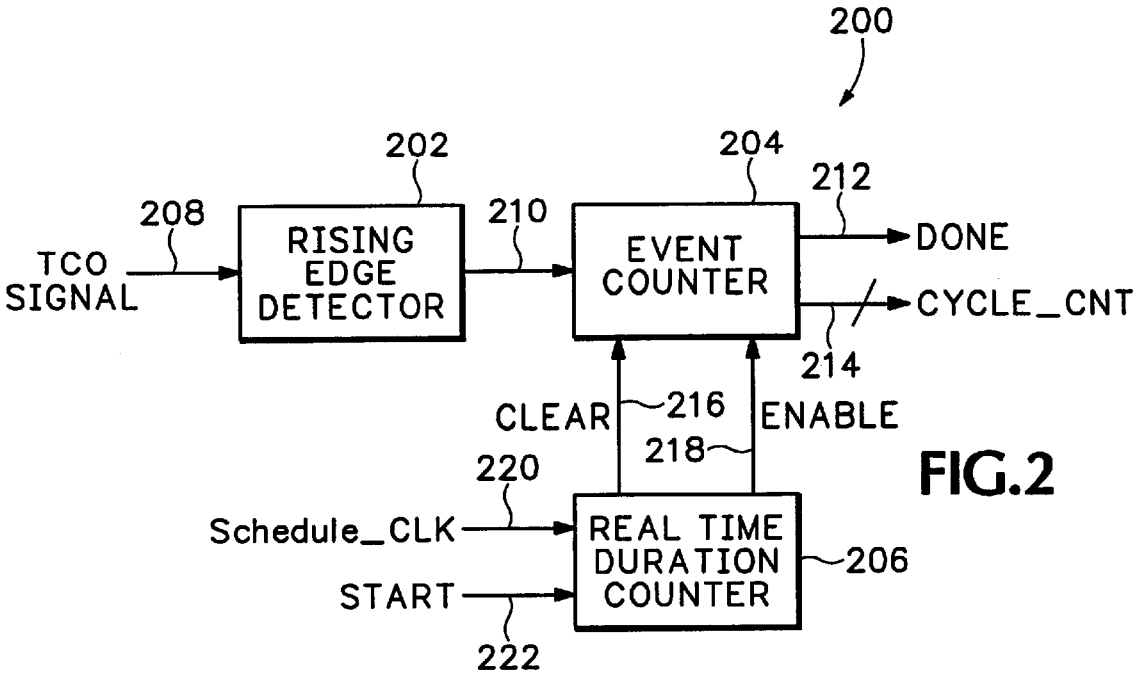
FIG. 2 is a block diagram of an embodiment of the head temperature sampler circuit shown in FIG. 1.

An embodiment of the HTS circuit 110 is an analog to digital (A/D) converter (not shown) that samples an analog signal line from the print head 104 encoding its temperature. Another embodiment of the HTS circuit 110 is shown in FIG. 2. Referring to FIG. 2, the HTS circuit 200 includes a rising edge detector 202 that detects a rising edge of a TCO signal 208 generated from a temperature sampling device 113.

An event counter 204 generates a count signal CYCLE_CNT 214 indicative of the number of rising edges detected by the rising edge detector 202 during a predetermined amount of time. The event counter 204 also generates a DONE signal 212 indicative of completing counting. The event counter 204 operates responsive to a clear signal 216 and an enable signal 218 generated by a duration counter 206. The event counter 204 clears the count when the duration counter 206 asserts the clear signal 216. Similarly, the event counter 204 enables the count when the duration counter 206 asserts the enable signal 218. The duration counter 206 generates the clear and enable signals 216 and 218, respectively, responsive to a real time clock signal 220 and a start signal 222. Put differently, the duration counter 206 sets the predetermined amount of time during which the event counter 204 counts rising edges of signal 210 responsive to the clock signal 220 and the start signal 222, the start signal being indicative of a start of the predetermined amount of time.

Returning to FIG. 1, the HTS circuit 110 generates and provides head temperature data 128 to a preheat data generator (PDG) circuit 112 responsive to the temperature sampling signals 120. The PDG circuit 112 receives the head temperature data 128 and generates therefrom the preheat temperature 130 responsive to the control signal 118. The PDG circuit 112 translates the head temperature data 128 into a data type appropriate for a preheat delivery unit (PDU) 116. For example, assuming the temperature data 122 is a pulse stream data type, the PDG circuit 112 delivers a string of digital data 130 to the PDU 116 representative of the pulse modulation pattern required by the head 104 to properly preheat the preheat devices 111 for the next nozzle firing.

A monitor circuit 114 eases control requirements of the temperature regulation controller 100 on the system 102. The monitor circuit 114 monitors the activity of the controller 100 and provides statistical data, e.g., out of range accesses or divides by zero errors, and interrupts as needed to keep the system running and maintained. For example, if the full range of values required in the PDG circuit 112 is larger than is feasible or cost effective to integrate into the controller 100, a subset of values is written into the PDG circuit 112—e.g., the lookup table 208 (FIG. 2). The monitor circuit 114 watches the accesses to the PDG circuit 112 and logs statistics, e.g., high hit, low hit, average hit, and trend so that the system 102 can query the appropriateness of the data included in the PDG 112 at any time. The monitor circuit 114 might additionally generate an interrupt signal (not shown separately from signals 134) notifying the system 102 that the table is out of range for the current head temperature profile. Responsive to this interrupt signal, the system 102 updates the PDG circuit 112 as necessary in real time. Put differently, the system 102 might update the PDG circuit 112 during operation if it finds that the values included in the PDG circuit 112 are inadequate to address the required temperature profile. Alternatively, the signals 128 are directly readable by the system 102. In this case, the system 102 determines the current static state of the inkjet head temperature and loads the table 308 (FIG. 3) with the correct starting data.

Figure 3:
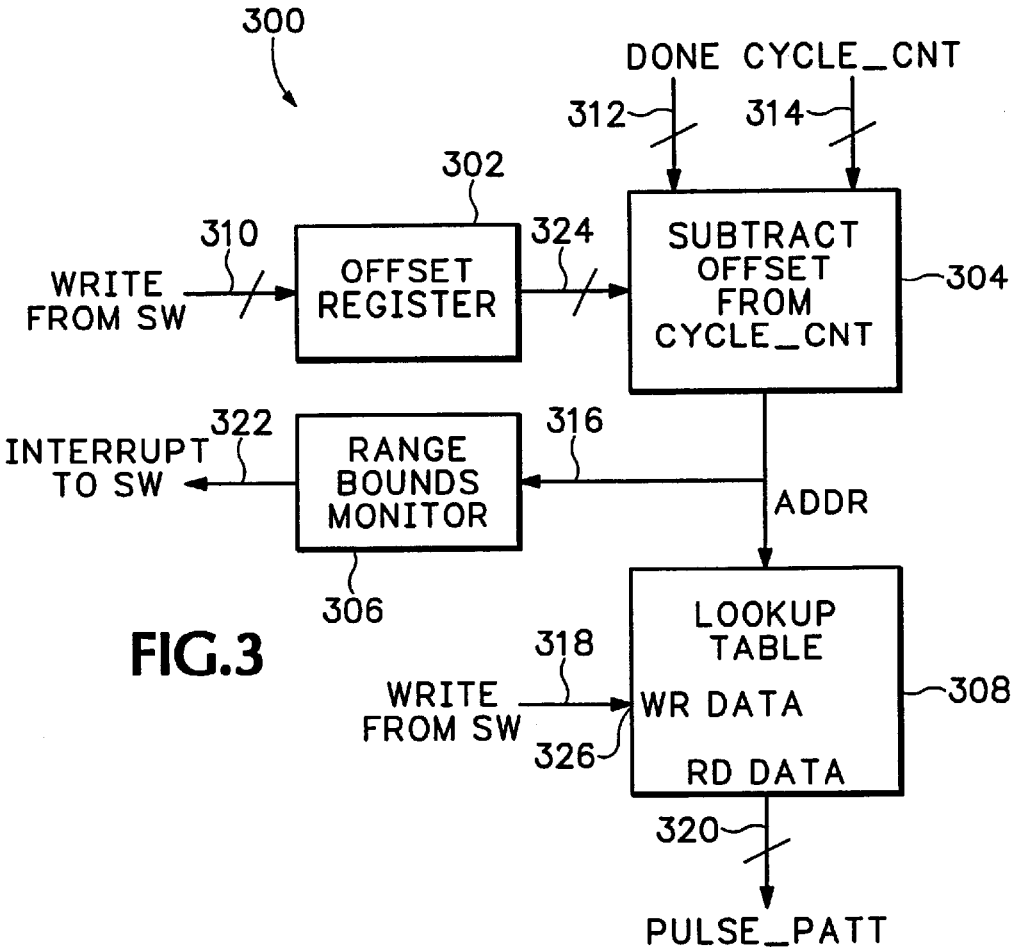
FIG. 3 is a block diagram of an embodiment of the preheat data generator and monitor circuit shown in FIG. 1.

FIG. 3 is a block diagram of one embodiment of the PDG circuit 112 and the monitor circuit 114 shown in FIG. 1. Referring to FIG. 3, the PDG circuit 300 is an integrated lookup table 308 comprising memory, e.g., a dual port random access memory (RAM). The table 308 is programmed prior to beginning circuit operation by the system 102 (FIG. 1) writing data 318 into the write terminal 326 of the table 308. The system 102 (FIG. 1) might load at any given time a range of values looked up by the HTS circuit 110. For example, the system 102 (FIG. 1) might load a subset range of values that it predicts will be looked up by the HTS circuit 110 (FIG. 1).

The PDG circuit 300 comprises an offset register 302 and a subtractor circuit 304. The subtractor circuit 304 receives the CYCLE_CNT signal 314 and DONE signal 312 from the HTS circuit 112 (FIG. 1). The PDG circuit 300 takes the CYCLE_CNT signal 314 and translates it to a PULSE_PATT signal 320 capable of being used by the PDU circuit 116 (FIG. 1). In one embodiment, the CYCLE_CNT signal 314 is an integer value in a specific range depending on the design of the HTS circuit 112—more particularly, the design of the counter 204 and the frequency of the of the TCO signal 208 (FIG. 2). To contain the size of the lookup table 308, it might contain a subset of the entire range of values the HTS might produce. An offset register 302 creates a dynamic reference signal 324. The offset register 302 subtracts an offset (not shown separately) from the CYCLE_CNT signal 314 received from the HTS circuit 112 (FIG. 1) and generate an ADDR signal 316 indicative of an address in the lookup table 308. The ADDR signal 316 addresses a selected pattern element (not shown) from the table to present to the PDU 116 (FIG. 1) on the PULSE_PATT signal 320.

A range bounds monitor circuit 306 monitors the ADDR signal 316 and generates an interrupt 322 to the system 102 (FIG. 1) when the ADDR signal 316 presents an erroneous address, e.g., a less than zero address or an address larger than the upper address of the lookup table 308. When the range bounds monitor 306 asserts the interrupt 322, the system 102 (FIG. 1) interrogates the monitor 306 and updates the contents of the lookup table 308 accordingly. For example, if the ADDR signal 316 is out of bounds, the range bounds monitor 306 asserts the interrupt signal 322. Responsive to interrupt signal 322, the system 102 (FIG. 1) updates the lookup table 308 and the offset register 302 such that the ADDR signal 316 is no longer out of range.

Returning to FIG. 1, another embodiment of the PDG circuit 112 is an off-chip lookup table comprising either RAM (not shown) or discrete flip-flops (not shown). Yet another embodiment of the PDG circuit 112 is a doubly indexed lookup table comprising RAM (not shown). This third embodiment might be advantageous for managing the size of the table by allowing a second lookup for defined fields of the preheat data signals 120. Yet other embodiments of the PDG circuit 112 might involve the implementation of a linear or non-linear formula. In this case, the PDG circuit 112 would actually formulate a preheat data element for each service cycle. This formula, implemented in software, hardware, or a combination of both, might include programmable coefficients and parameters. By designing in flexibility, the PDG circuit 112 might be tailored to a variety of different print head types.

The temperature regulation controller 100 additionally contemplates a controller 100 that does not need a PDG circuit 112. This situation would exist if the temperature data 128 arrived from the head 104 mapped directly to the data type 130 required by the PDU 116.

As explained above, the PDG circuit 112 translates the head temperature data 128 into a data type appropriate for the PDU 116. For example, assuming the temperature data 128 is a pulse stream data type, the PDG circuit 112 delivers a string of digital data to the PDU 116 representative of the pulse modulation pattern required by the head 104 to properly preheat the preheat devices 111 for the next nozzle firing. The PDG 112 delivers the preheat temperature data 130 synchronized on data element boundaries or nozzle firings. Alternatively, the PDG 112 delivers the preheat temperature data 130 in between nozzle firings. The PDU 116, in turn, manages delivery of the preheat temperature data 130 to the plurality of preheating devices 111 on the print head 104 through the plurality of preheat data signals 122.

Figure 4:
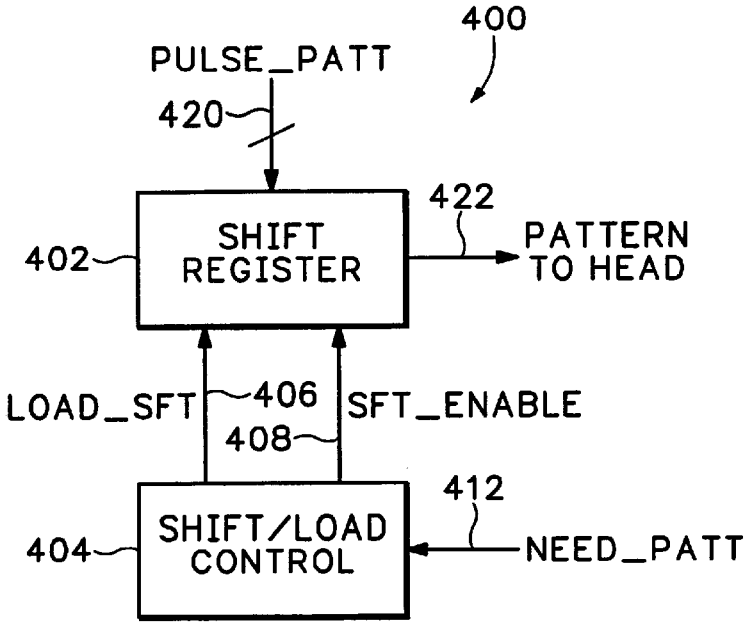
FIG. 4 is a block diagram of an embodiment of the preheat delivery unit shown in FIG. 1.

FIG. 4 is a block diagram of one embodiment of the PDU 116 shown in FIG. 1. The PDU 400 manipulates a PULSE_PATT signal 420 received from the PDG circuit 112 (FIG. 1) and generates a PATTERN signal 422 which it delivers to the head 104 (FIG. 1). The PULSE_PATT signal 420 in this embodiment is a pattern of bits that when delivered by serial shifter to the head 104 (FIG. 1), preheat the nozzles the optimal amount for the current temperature profile most recently read by the HTS circuit 110 (FIG. 1). The PDU 400 includes a shift/load control block 404 that waits for a NEED_PATT signal 412 request from the print head 104. Once the shift/load control block 404 receives the NEED_PATT signal 412, it generates a LOAD_SFT signal 406 and a SFT_ENABLE signal 408. A shift register 402 serially loads the latest update from the PULSE_PATT signal 420 to the PATTERN signal 422 responsive to the LOAD_SFT signal 406 and SFT_ENABLE signal 408.

Returning to FIG. 1, the temperature regulation controller 100 comprises a programmable time base (PTB) circuit 106 coupled to a scheduler circuit 108, both used to pace operation of the controller 100. That is, the PTB circuit 106 is a convenience circuit that allows the controller 100 to be used in a system where it requires specific real time clock frequencies but does not dictate to the system 102 what clocks it must provide.

The PTB circuit 106 might be programmable by the system 102 but the invention is not limited in this regard. One embodiment of the PTB circuit 106 is a programmable counter (not shown) running on a square wave digital clock (not shown). Another embodiment of the PTB circuit 106 is a programmable clock divider (not shown) that can be programmed to divide down an input clock (not shown) from the system 102 with a wide range of possible frequencies to a frequency that is needed by the controller 100 to cycle the head temperature profile updates.

Figure 5:
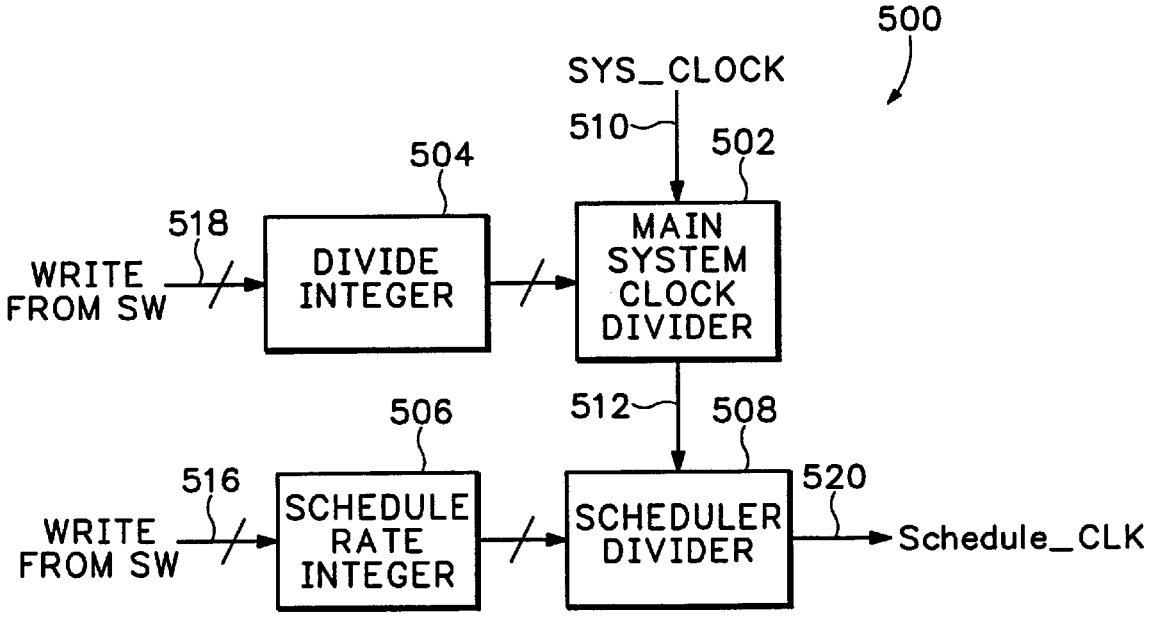
FIG. 5 is a block diagram of an embodiment of the programmable time base and scheduler circuits shown in FIG. 1.

FIG. 5 is a block diagram of an embodiment of the PTB circuit 106 and the scheduler circuit 108 shown in FIG. 1. A divide integer block 504 receives a first write signal 518 from the system 102 typically at power but other reception times come within the invention. The first write signal 508 is, in one embodiment, an integer number. A main system clock divider 502 receives a SYS_CLK signal 510 and generates a divided clock signal 512 responsive to the signal 518 stored divide integer 504. This is because the SYS_CLK signal 510 is generally much higher frequency than is required by the scheduler 508. Also, the operating frequency of the scheduler 508 is fixed while the SYS_CLK signal 510 frequency might depend on its associated product.

A schedule rate integer 506 receives a second write signal 516 from the system 102 (FIG. 1). A scheduler divider 508 generates a Schedule_CLK signal 520 by manipulating the output of the main system clock divider 502 responsive to the output of the schedule rate integer 506. The second write signal 506 is, in one embodiment, an integer number. The scheduler integer 508 might be a register that holds an integer value for signal 506. The Schedule_CLK signal 520 is a signal whose frequency is determined by the system 102 through the first and second write signals 518 and 516, respectively, based on knowledge of the particulars of the print head 104 such that the head temperature profile updates happen at an optimal rate. By so providing the first and second write signals 518 and 516, respectively, the system 102 might select the schedule rate 520 based on the type of print head installed, the type of print mode selected (e.g., highest quality, draft, and economy), and the like. In short, the circuit 500 operates as a two-stage clock divider with programmable divide values.

Referring to FIGS. 1 and 5, the controller 100 operates equally well in a system where the print head 104 includes one temperature sensor and one preheating device as it does in a system with a plurality of temperature sensors and a plurality of preheating devices. In a system like that shown in FIG. 1 comprising a plurality of temperature sensors 113, the PDG circuit 112 might allow sharing of the lookup table so that all sensors (or channels) will have access to the same temperature to preheat data conversion.

It is conceivable that the controller 100 will be able to adapt to the head temperature much faster than required by the head due to slower temperature gradient profile of the head compared to the cycle of the controller 100. In this case, the controller 100 envisions interleaving the sensor (or channel) service intervals using a scheduler, e.g., schedule rate integer 506 and scheduler divider 508 (FIG. 5). These blocks might include software programmable features such as channel order and frequency of service for each channel, if the frequency of service differs between channels.

A person skilled in the art should recognize that an embodiment of the controller 100 is a monolithic integrated circuit. It should also be readily apparent that one or more devices that include logic circuit might implement the present invention. A dedicated processor system that includes a microcontroller or a microprocessor might alternatively implement the present invention.

The invention additionally provides methods, which are described below. Moreover, the invention provides apparatus that performs or assists in performing the methods of the invention. This apparatus might be specially constructed for the required purposes or it might comprise a general-purpose computer selectively activated or reconfigured by a computer program stored in the computer. The methods and algorithms presented herein are not necessarily inherently related to any particular computer or other apparatus. In particular, various general-purpose machines might be used with programs in accordance with the teachings herein or it might prove more convenient to construct more specialized apparatus to perform the required method steps. The required structure for a variety of these machines will appear from this description.

Useful machines or articles for performing the operations of the present invention include general-purpose digital computers or other similar devices. In all cases, there should be borne in mind the distinction between the method of operating a computer and the method of computation itself. The present invention relates also to method steps for operating a computer and for processing electrical or other physical signals to generate other desired physical signals.

The invention additionally provides a program and a method of operation of the program. The program is most advantageously implemented as a program for a computing machine, such as a general-purpose computer, a special purpose computer, a microprocessor, and the like.

The invention also provides a storage medium that has the program of the invention stored thereon. The storage medium is a computer-readable medium, such as a memory, and is read by the computing machine mentioned above.

A program is generally defined as a sequence of processes leading to a desired result. These processes, also known as instructions, are those requiring physical manipulations of physical quantities. Usually, though not necessarily, these quantities take the form of electrical or magnetic signals capable of being stored, transferred, combined, compared, and otherwise manipulated or processed. When stored, they might be stored in any computer-readable medium. It is convenient at times, principally for reasons of common usage, to refer to these signals as bits, data bits, samples, values, elements, symbols, characters, images, terms, numbers, or the like. It should be borne in mind, however, that all of these and similar terms are associated with the appropriate physical quantities, and that these terms are merely convenient labels applied to these physical quantities.

This detailed description is presented largely in terms of flowcharts, display images, algorithms, and symbolic representations of operations of data bits within a computer readable medium, such as a memory. Such descriptions and representations are the type of convenient labels used by those skilled in programming and/or the data processing arts to effectively convey the substance of their work to others skilled in the art. A person skilled in the art of programming might use this description to readily generate specific instructions for implementing a program according to the present invention. For the sake of economy, however, flowcharts used to describe methods of the invention are not repeated in this document for describing software according to the invention.

Often, for the sake of convenience only, it is preferred to implement and describe a program as various interconnected distinct software modules or features, collectively also known as software. This is not necessary, however, and there might be cases where modules are equivalently aggregated into a single program with unclear boundaries. In any event, the software modules or features of the present invention might be implemented by themselves, or in combination with others. Even though it is said that the program might be stored in a computer-readable medium, it should be clear to a person skilled in the art that it need not be a single memory, or even a single machine. Various portions, modules or features of it might reside in separate memories or separate machines where the memories or machines reside in the same or different geographic location. Where the memories or machines are in different geographic locations, they might be connected directly or through a network such as a local access network (LAN) or a global computer network like the Internet®.

In the present case, methods of the invention are implemented by machine operations. In other words, embodiments of the program of the invention are made such that they perform methods of the invention that are described in this document. These might be optionally performed in conjunction with one or more human operators performing some, but not all of them. As per the above, the users need not be collocated with each other, but each only with a machine that houses a portion of the program. Alternately, some of these machines might operate automatically, without users and/or independently from each other.

Methods of the invention are now described. A person having ordinary skill in the art should recognize that the boxes described below might be implemented in different combinations, and in different order. Some methods might be used for determining a location of an object, some to determine an identity of an object, and some both.

Figure 6:
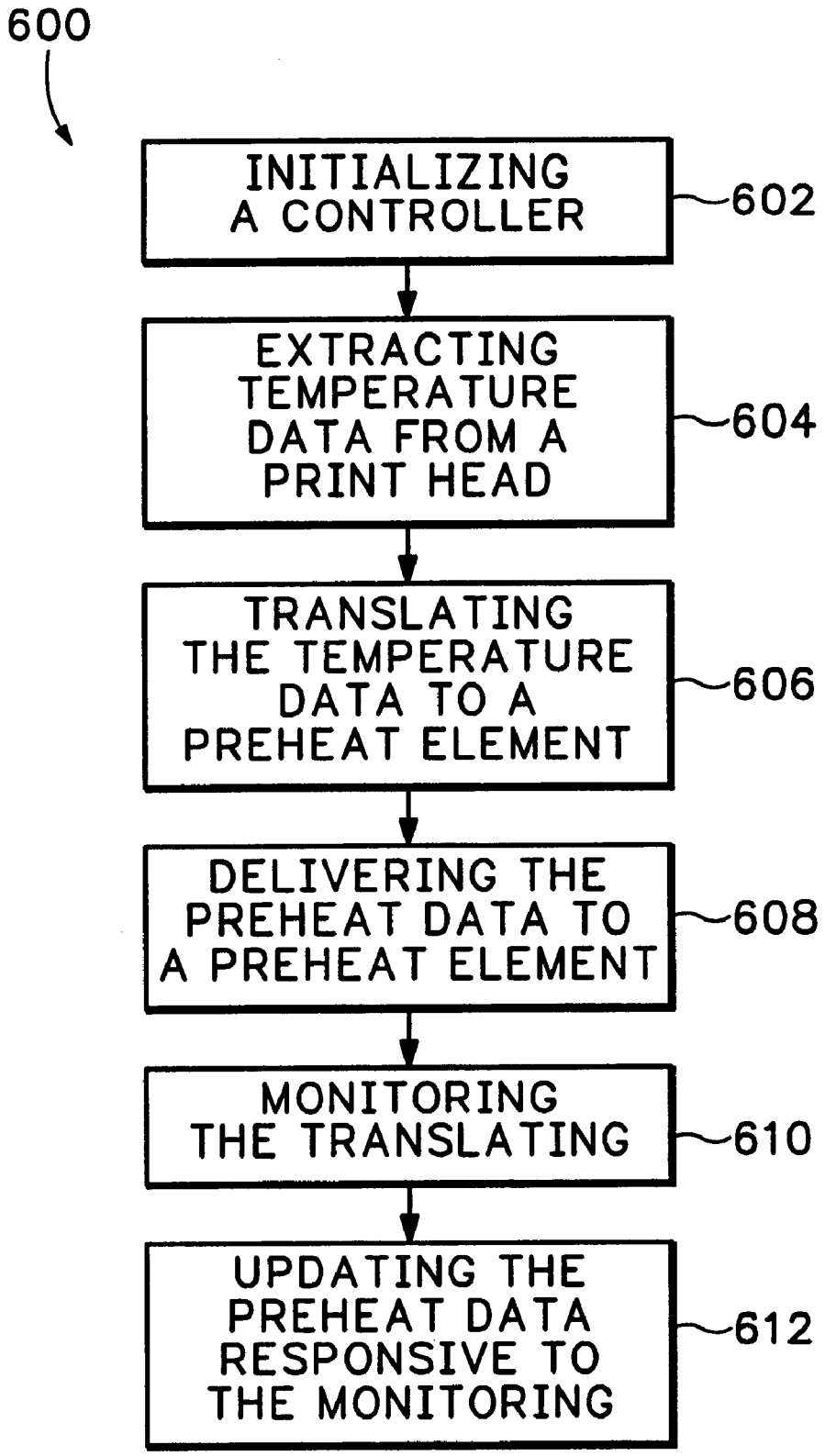
FIG. 6 is a flowchart of an embodiment of the inkjet method temperature regulation system of the present invention.

FIG. 6 is a flowchart of a method 600 of performing an embodiment of the present invention. At box 602, the method 600 initializes a controller. The initializing a controller might include initializing a look up table by writing in initial preheat data into a look up table contained in a PDG circuit. At box 604, the method 600 extracts temperature data from a print head. The temperature data might be obtained from one or a plurality of heat sensors and might take on a variety of different forms. In one embodiment, the temperature data is an oscillating TCO signal whose frequency is indicative of a print head temperature. In this case, the extracting temperature data includes counting signal transitions of the oscillating signal, the signal transitions being indicative of a print head temperature.

At box 606, the method 600 translates the temperature data to preheat data. The translating might include looking up the preheat data corresponding to the temperature data in a look up table, e.g., a RAM memory. At box 608, the preheat data is delivered to a preheat element on the print head. The data delivery might by synchronized to data element boundaries and accomplished using a shift register. At box 610, the method 600 monitors the translating of the temperature data and collects statistical information regarding the translating. The statistical information is used by external circuitry to update the look up table included in the PDG circuit such that it more accurately reflects the temperature profile of the particular print head being queried (box 612).

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. An inkjet temperature regulation controller, comprising:

a time base circuit adapted to generate a clock signal;

a head temperature sampler adapted to generate head temperature data by sensing print head temperature responsive to the clock signal;

a preheat data generating circuit adapted to translate the head temperature data into head preheat temperature data by looking up the head preheat temperature data corresponding to the head temperature data in a look up table;

a preheat data delivering circuit adapted to provide the preheat temperature data to at least one preheating element; and a monitor circuit adapted to generate statistical data about the look up table;

wherein the preheat data generating circuit updates the look up table responsive to the statistical data.

2. The inkjet temperature regulation controller of claim 1 wherein the preheat data delivering circuit operates responsive to a control signal; and wherein the control signal is generated by external circuitry.

3. The inkjet temperature regulation controller of claim 1 wherein the head temperature sampler is adapted to read at least one heat sensor on the inkjet print head.

4. The inkjet temperature regulation controller of claim 3 wherein the head temperature sampler includes:

a rising edge detector adapted to detect a rising edge of a heat sensor signal;

an event counter adapted to count rising edges in the heat sensor signal over a predetermined amount of time; and a duration counter adapted to determine the predetermined amount of time.

5. The inkjet temperature regulation controller of claim 1 wherein the head temperature sampler includes a counter.

6. The inkjet temperature regulation controller of claim 1 wherein the preheat data generating circuit is adapted to translate the head temperature data into a data type appropriate for the preheat data delivering circuit.

7. The inkjet temperature regulation controller of claim 1 wherein the look up table is a random access memory.

8. The inkjet temperature regulation controller of claim 1 wherein the preheat data generating circuit operates responsive to a control signal and includes:

an offset register receiving the control signal;

a subtractor coupled to the offset register and adapted to generate an address signal responsive to a count signal received from the head temperature sensor circuit; and a bounds monitor circuit adapted to determine if the address signal is within a range of addresses of the look up table.

9. An inkjet temperature regulation controller, comprising:

a time base circuit adapted to generate a clock signal;

a head temperature sampler adapted to generate head temperature data by sensing print head temperature responsive to the clock signal;

a preheat data generating circuit adapted to translate the head temperature data into head preheat temperature data;

a preheat data delivering circuit adapted to provide the preheat temperature data to at least one preheating element; and a monitor circuit adapted to generate statistical data according to the head temperature data;

wherein the preheat data generating circuit receives updated head preheat temperature data responsive to the statistical data;

wherein the preheat data delivering circuit is adapted to synchronize delivery of preheat data to the head preheating element according to data element boundaries.

10. The inkjet temperature regulation controller of claim 1 wherein the preheat data delivering circuit includes a shift register.

11. An inkjet temperature regulation controller, comprising:

a time base circuit adapted to generate a clock signal;

a head temperature sampler adapted to generate head temperature data by sensing print head temperature responsive to the clock signal;

a preheat data generating circuit adapted to translate the head temperature data into head preheat temperature data;

a preheat data delivering circuit adapted to provide the preheat temperature data to at least one preheating element; and a monitor circuit adapted to generate statistical data according to the head temperature data;

wherein the preheat data generating circuit receives updated head preheat temperature data responsive to the statistical data;

wherein the time base circuit comprises:

a divide integer circuit adapted to divide a first external signal by a first integer number;

a main system clock divider adapted to divide a system clock signal;

a schedule rate integer adapted to receive a second external signal; and a scheduler adapted to generate the clock signal responsive to an output of the main system clock divider and an output of the schedule rate integer.

12. A method for regulating temperature on an inkjet print head, comprising:

initializing controller;

extracting temperature data from a print head;

looking up preheat data corresponding to the temperature data in a look up table;

delivering the preheat data to a preheat element;

monitoring the looking up of the preheat data; and updating the preheat data in the look up table responsive to the monitoring.

13. The method of claim 12 comprising initializing the look up table.

14. The method of claim 12 wherein extracting temperature data comprises reading at least one temperature sensor.

15. The method of claim 14 wherein reading at least one temperature sensor comprises counting signal transitions of an oscillating signal indicative of print head temperature.

16. The method of claim 12 wherein looking up comprises translating the temperature data having a first data type to preheat data having a second data type.

17. The method of claim 16 wherein the first data type being generated by at least one temperature sensor on the print head and the second data type being capable processing by a preheating element on the print head.

18. A method for regulating temperature on an inkjet print head, comprising:

initializing a controller;

extracting temperature data from a print head;

translating the temperature data to preheat data;

delivering the preheat data to a preheat element;

monitoring the translating of the temperature data; and updating the preheat data responsive to the monitoring;

wherein delivering the preheat data includes synchronizing delivery of preheat data to the preheat element on data element boundaries.

19. The method of claim 12 wherein delivering the preheat data includes shift registering the preheat data to the preheat element.

20. The method of claim 19 wherein monitoring includes collecting statistical data regarding the looking up.

21. The method of claim 20 wherein collecting statistical data includes collecting hi, low, and average hits and trends regarding the looking up.

22. The method of claim 20 comprising updating the look up table responsive to the statistical data.

23. The method of claim 22 comprising scheduling extracting temperature data.

24. A method for regulating temperature on an inkjet print head, comprising:

initializing a controller;

extracting temperature data from a print head;

translating the temperature data to preheat data;

delivering the preheat data to a preheat element;

monitoring the translating of the temperature data; and updating the preheat data responsive to the monitoring;

scheduling extracting temperature data;

wherein scheduling extracting temperature data includes interleaving readings of each of a plurality of temperature sensors.

25. A temperature regulation controller, comprising:

a programmable time base circuit adapted to generate a controller clock;

sampler circuit adapted to generate temperature data by reading at least one temperature sensor on an inkjet print head indicative of a print head temperature responsive to the controller clock;

a preheat data generating circuit adapted to look up preheat data corresponding to the temperature data in a look up table;

a preheat data delivering circuit adapted to provide the preheat data to a preheat element; and a monitor circuit adapted to collect statistical data concerning the look up table;

wherein monitor circuit updates the temperature data in the look up table responsive to the statistical data.

* * * * *